United States Patent [19]

Jachowski et al.

[11] Patent Number: 4,619,692

[45] Date of Patent: Oct. 28, 1986

[54] PROCESS FOR THE PRODUCTION OF METALLIC SEMI-FINISHED PRODUCTS

[75] Inventors: Johannes Jachowski, Duisburg; Paul Pant, Essen, both of Fed. Rep. of Germany

[73] Assignee: Fried Krupp GmbH, Fed. Rep. of Germany

[21] Appl. No.: 755,132

[22] Filed: Jul. 15, 1985

[30] Foreign Application Priority Data

Jul. 14, 1984 [DE] Fed. Rep. of Germany ..... 3426086

[51] Int. Cl.[4] ..... C22B 4/00

[52] U.S. Cl. ..... 75/10.25

[58] Field of Search ..... 75/10 R, 10 C, 10 V

[56] References Cited

U.S. PATENT DOCUMENTS

| | | | |
|---|---|---|---|
| 3,257,197 | 6/1966 | Death | 75/10 R |
| 3,723,630 | 3/1973 | Paton | 75/10 R |
| 3,989,091 | 11/1976 | Medovar | 75/10 R |

*Primary Examiner*—Peter D. Rosenberg

*Attorney, Agent, or Firm*—Sughrue, Mion, Zinn, Macpeak, and Seas

[57] ABSTRACT

A process for the production of metallic semi-finished products which contains one or several alloys and has at least two zones with different nitrogen content. An electrode is remelted by pressure electroslag remelting, wherein the remelting process occurs in at least two steps, in each of which differing amounts of nitrogen in the form of solid nitrogen donators are added to the melt, and wherein the pressure produced by a nitrogen- or noble gas-atmosphere is changed from remelting step to remelting step in a range of 5 to 50 bar.

11 Claims, No Drawings

PROCESS FOR THE PRODUCTION OF METALLIC SEMI-FINISHED PRODUCTS

BACKGROUND OF THE INVENTION

The present invention relates to a process for the production of a metallic semi-finished product, which contains of one or several alloys and has at least two zones with different nitrogen content.

Structural members made of different metallic materials are today produced in such a way that metallic semi-finished products which are produced according to different techniques and have different shapes, for example, bars, billets, blanks and are made of different alloys, are worked by molding processes, for example, forging, and are then fit together by joining processes, for examples, welding, soldering and the like. These structural members have different characteristics in individual zones, because the zones are formed corresponding to the production process of semi-finished products in every case with different chemical compounds. However, the structural members produced by joining processes have the disadvantage that they have at least one connective surface caused by the process, by which the two shaped semi-finished products are in each case bound with each other. However, in some modes of application these connective surfaces are the weakest points.

SUMMARY OF THE INVENTION

An object of the present invention is therefore to provide a process for the production of a metallic semi-finished product, which has zones with different chemical compositions adapted to each stress, as well as no connective surface susceptible to trouble, and which can be further processed for example by forging.

Additional objects and advantages of the present invention will be set forth in part in the description or can be learned by practice of the invention. The objects and advantages are achieved by means of the processes, instrumentalities and combinations particularly pointed out in the appended claims.

To achieve the foregoing objects and in accordance with its purpose, the present invention provides a process for the production of a metallic semi-finished product, which contains one or several alloys and has at least two zones with different nitrogen content, comprising remelting an electrode by pressure electroslag remelting, wherein the remelting process occurs in at least two remelting steps, in each of which differing amounts of nitrogen in the form of solid nitrogen donators are added to the melt, and wherein the pressure produced by a nitrogen- or noble gas-atmosphere is changed from remelting step to remelting step in a range of 5 to 50 bar.

According to the present invention, it is therefore possible to raise or lower the pressure from remelting step to remelting step in a range of 5 to 50 bar, that is, the pressure in the subsequent remelting step can be 5 to 50 bar higher or lower than the pressure in the immediately preceding remelting step. Deoxidizing agents can be added to the solid nitrogen donators, as is customary in the known pressure electroslag remelting process.

The electrode which is remelted can comprise a unitary electrode, that is, a one piece electrode having a substantially uniform composition throughout or can comprise several differently composed electrode parts.

With the process according to the present invention, a metallic semi-finished product can be produced that has several zones with differing characteristics and is in one piece. It has proven to be particularly advantageous that differing amounts of nitrogen can be alloyed to the melt in every remelting step. The result of this step-wise remelting process is a semi-finished product that has zones with differing nitrogen content that are clearly delimited from each other, wherein the transition ranges do not have a disadvantageous effect on the characteristics of the semi-finished product.

Although from German Published Patent Application No. 29 24 415, a process for adding nitrogen to high-alloyed steel is known, by which a pressure of 1 to 60 bar is maintained during the electroslag remelting of the steel by nitrogen and/or argon, and a deoxidation agent as well as a nitrogen donator with high nitrogen content are continually added to the slag during the remelting, it could not be anticipated that the nitrogen addition can be so controlled that the semi-finished products produced by pressure electroslag remelting have several zones with differing nitrogen content.

In a further embodiment of the present invention, $Si_3N_4$ preferably is used as solid nitrogen donator. This measure has proven to be particularly successful because $Si_3N_4$ dissolves well in the slag present with electroslag remelting and is decomposed with optimum speed. Along with $Si_3N_4$, also CrN and MnM can be used as a solid nitrogen donator.

The pressure electroslag remelting preferably is carried out at 1.5 to 100 bar, and the slag used preferably has the following composition: 30 to 70% $CaF_2$, 20 to 40% CaO, 0 to 30% $Al_2O_3$, and 0 to 10% $SiO_2$.

It is to be understood that both the foregoing general description and the following detailed description are exemplary and explanatory, but are not restrictive of the invention.

DETAILED DESCRIPTION OF THE INVENTION

Electroslag remelting (ESR) is a known refining process for producing metallic products in which a metal is first formed into an electrode, for example, by casting and or forging, and the electrode is then remelted in a water cooled copper mold. Remelted metal-droplets deposited in a pool of molten metal on the top of the ingot being built up in the mold. The remelting takes place under a layer of slag which removes unwanted impurities. The electrode is melted by heat generated in the slag because of its resistance to electric current passing through it. The slag refines the electrode metal as it advances through the slag layer into the molten metal pool which is below the slag.

In the present invention, the electrode is remelted in two or more steps, with the conditions of the remelting changing during each step. The remelted metal from the second step is deposited directly on the remelted metal from the first step while the remelted metal from the first step which has been deposited last is still in molten state in the mold. This process is repeated for each further step.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

An electrode which consists of an alloy with the composition 0.05% C, 13% Cr and the remainder Fe, is remelted to a quarter of its size by electroslag remelting under a nitrogen pressure of 5 bar, wherein 4 grams of pellets, with a size of about 0.5 mm to 4 mm and which consist of 80% $Si_3N_4$ and 20% CaSiMg, are continuously added to the slag per kg of remelted material, that is, per kg of material being remelted in the first remelting step. The zone produced in the first remelting step of the semi-finished bar has a nitrogen content of 0.05%.

In the second remelting step, the nitrogen pressure is raised to 40 bar, and 30 grams of pellets with a size of about 0.5 mm to 4 mm and with the above-named composition are continuously added to the slag per kg of remelted material, that is, per kg of material being remelted during the second remelting step. The zone of the semi-finished bar produced in the second remelting step has a nitrogen content of 0.5%.

The semi-finished bar is then worked by hot working into a turbine blade for water turbines. After an annealing treatment at 1000° C. and a tempering treatment at 650° C., the turbine blade possesses the characteristics given in Table 1 below.

The symbols used in Table 1 and the tables in the other examples have the following meaning: [Units]

$R_{pO.2}$=yield point [N/mm²]

$R_m$=tensile strength [N/mm²]

$A_5$=elongation [%]

Z=contraction [%]

$a_K$=notch impact strength [F]

TABLE 1

| Zone | Test Temperature 20° C. $R_{pO.2}$ N/mm² | $R_m$ N/mm² | $A_5$ % | Determining characteristics |
|---|---|---|---|---|
| N—Content 0.5% | 850 | 1050 | 17 | High strength cavitation resistant stress corrosion resistant |
| N—Content 0.05% | 300 | 600 | 20 | Can be machined well, can be welded well |

EXAMPLE 2

An electrode consisting of an alloy with the composition 0.03% C, 23% Cr, 3% Mn, 4% Ni, 3% Mo and the remainder Fe, is remelted under pressure in an electroslag remelting installation. Half of the electrode is remelted in the first remelting step at an argon pressure of 5 bar, wherein 7 grams of pellets with the composition given in Example 1 are added to the slag per kg of remelted material, that is, per kg of material being remelted in the first melting step. The zone of the semi-finished bar produced in the first remelting step has a nitrogen content of 0.1%.

Then, the remaining half of the electrode is remelted in a second remelting step in which the argon pressure is raised to 36 bar, and a continuous addition of 50 grams of pellets with the composition given in Example 1 occurs per kg of remelted material, that is, per kg of the material being remelted in the second melting step. The zone of the semi-finished bar produced in the second remelting step has a nitrogen content of 0.8%.

The semi-finished bar remelted in two steps is worked into a structural member by hot working. After an annealing treatment at 1100° C. with a subsequent quenching in water, the different zones of the product exhibit the characteristics given in Table 2 below.

TABLE 2

| Zone | Structure | Test Temperature 20° C. $R_{pO.2}$ N/mm² | $R_m$ N/mm² | $A_5$ % | Z % | $a_K$ J | Suitability for welding |
|---|---|---|---|---|---|---|---|
| N—Content 0.8% | Austenite | 610 | 980 | 50 | 70 | 200 | difficult |
| N—Content 0.1% | 80% Ferrite remainder Austenite | 420 | 730 | 32 | 60 | 80 | Very good |

EXAMPLE 3

Two cast partial electrodes consisting of differing alloys, with the composition of the first alloy being 0.03% C, 1% Mn, 13.5% Cr, 3% Ni, 3.5% Mo, and the remainder Fe (ferritic structure), and the composition of the second alloy being 0.03% C, 18% Cr, 13% Ni, 3% Mo, and the remainder Fe (austenitic structure), are joined into an electrode by welding. With electroslag remelting, at first the austenitic part of the electrode is remelted at a nitrogen pressure of 5 bar, wherein 7 grams of pellets with the composition given in Example 1 are added to the slag per kg of remelted material, that is, per kg of material remelted in the first melting step. The zone of the semi-finished bar produced in the first remelting step has a nitrogen content of 0.1%.

In the second remelting step, the ferritic part of the electrode is remelted at an argon pressure of 40 bar, wherein 30 grams of pellets with the composition given in Example 1 are added to the slag per kg of remelted material, that is, per kg of material being remelted in the second remelting step. The zone of the semi-finished bar produced in the second remelting step has a nitrogen content of 0.5%.

The semi-finished bar is subsequently worked into a structural member by hot working. After an annealing treatment at 1050° C. with a subsequent quenching in water, the different zones of the product exhibit the characteristics given in Table 3 below.

TABLE 3

| Zone | Structure | Test Temperature 20° C. $R_{pO.2}$ N/mm² | $R^m$ N/mm² | $A^5$ % | Z % | 600° C. $R_{pO.2}$ N/mm² | $R_m$ N/mm² | $A_5$ % | Z % |
|---|---|---|---|---|---|---|---|---|---|
| N—Content 0.5% | BAINIT | 650 | 1300 | 15 | 35 | 400 | 650 | 27 | 60 |
| N—Content | Austenite | 300 | 640 | 48 | 73 | 135 | 460 | 45 | 64 |

TABLE 3-continued

| | | Test Temperature | | | | | | | |
|---|---|---|---|---|---|---|---|---|---|
| | | 20° C. | | | | 600° C. | | | |
| Zone | Structure | $R_{pO.2}$ N/mm² | $R^m$ N/mm² | $A^5$ % | Z % | $R_{pO.2}$ N/mm² | $R_m$ N/mm² | $A_5$ % | Z % |
| 0.1% | | | | | | | | | |

It will be understood that the above description of the present invention is susceptible to various modifications, changes and adaptations, and the same are intended to be comprehended within the meaning and range of equivalents of the appended claims.

What is claimed is:

1. Process for the production of a metallic semi-finished product which contains at least one alloy and which has at least two zones with different nitrogen content, comprising remelting an electrode, by pressure electroslag remelting, wherein the remelting occurs in at least two steps, in each of which differing amounts of nitrogen in the form of solid nitrogen donators are added to the melt, and wherein the pressure produced by a nitrogen- or noble gas-atmosphere is changed from remelting step to remelting step in a range of 5 to 50 bar.

2. Process according to claim 1, wherein $Si_3N_4$ is used as a solid nitrogen donator.

3. Process according to claim 1, wherein the electrode which is remelted comprises several differently composed electrode parts.

4. Process according to claim 1, wherein the electrode which is remelted has a substantially uniform composition.

5. Process according to claim 1, wherein the pressure during the second remelting step is 5 to 50 bar higher than the pressure in the first remelting step.

6. Process according to claim 1, wherein the pressure during the second remelting step is 5 to 50 bar lower than the pressure in the first remelting step.

7. Process according to claim 1, wherein the pressure slag remelting is carried out at a 1.5 to 100 bar.

8. Process according to claim 1, wherein the slag has a composition of 30 to 70% $CaF_2$, 20 to 40% CaO, 0 to 30% $Al_2O_3$ and 0 to 10% $SiO_2$.

9. Process according to claim 1, wherein the solid nitrogen donator is CrN or MnN.

10. Process according to claim 1, wherein $Si_3N_4$ is used as the solid nitrogen donator, wherein the pressure slag remelting is carried out at a 1.5 to 100 bar, and the slag has a composition of 30 to 70% $CaF_2$, 20 to 40% CaO, 0 to 30% $Al_2O_3$ and 0 to 10% $SiO_2$.

11. Process according to claim 10, wherein the pressure during the second remelting step is 5 to 50 bar higher than the pressure in the first melting step.

* * * * *